US009456665B2

(12) United States Patent
Stubblefield

(10) Patent No.: US 9,456,665 B2
(45) Date of Patent: Oct. 4, 2016

(54) FOLDED CLOTHING CLIP HOLDER

(71) Applicant: Oliver Eugene Stubblefield, Houston, TX (US)

(72) Inventor: Oliver Eugene Stubblefield, Houston, TX (US)

(73) Assignee: Oliver Eugene Stubblefield, Houston, TX (US)

( * ) Notice: Subject to any disclaimer, the term of this patent is extended or adjusted under 35 U.S.C. 154(b) by 0 days.

(21) Appl. No.: 14/098,791

(22) Filed: Dec. 6, 2013

(65) Prior Publication Data

US 2015/0157098 A1 Jun. 11, 2015

(51) Int. Cl.

| | |
|---|---|
| ***A44B 99/00*** | (2010.01) |
| ***G09F 23/00*** | (2006.01) |
| ***B65D 85/18*** | (2006.01) |

(52) U.S. Cl.

CPC ..... *A44B 99/00* (2013.01); *B65D 85/18* (2013.01); *G09F 23/00* (2013.01); *Y10T 24/44778* (2015.01); *Y10T 24/44863* (2015.01)

(58) Field of Classification Search

CPC ... Y10T 24/20; Y10T 24/202; Y10T 24/205; Y10T 24/44641; Y10T 24/44769; Y10T 24/44778; Y10T 24/44786; Y10T 24/44983; Y10T 24/44923; B42F 1/02; B42F 1/04; B42F 1/06; B42F 1/08; F16B 5/06

USPC ..... 24/556, 67.3, 67.9, 546, 67 R, 551, 547, 24/545, 561, 563

See application file for complete search history.

(56) References Cited

U.S. PATENT DOCUMENTS 4,055,874 A * 11/1977 Brown ..... 24/67.3
2008/0189919 A1* 8/2008 Keefer et al. ..... 24/563

* cited by examiner

*Primary Examiner* — Robert J Sandy
*Assistant Examiner* — Michael Lee

(57) ABSTRACT

The invention is a clip holder that can be applied to fabric or clothing, specifically shirts or underwear, designed to aid in maintaining the folded status of the garment. The holder has two horizontal, parallel posts with space between them on one side, which descend or curve down on the same end and then converge to form a single post in the center, which then turns horizontally in the same direction as the two posts above and is almost parallel to the two posts. From a side view, the shape of the holder appears as a "U" shape, which narrows at the opening compared to the interior of the holder. It is this narrowing that enhances the gripping ability of the holder on the folded garment. Because the single post fits between the top posts, two folded garments with this invention applied become easily stackable.

7 Claims, 3 Drawing Sheets

FIG. 2A
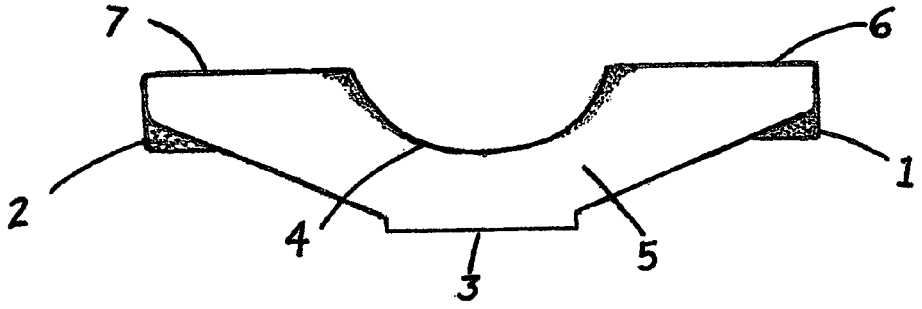
FIG. 2B
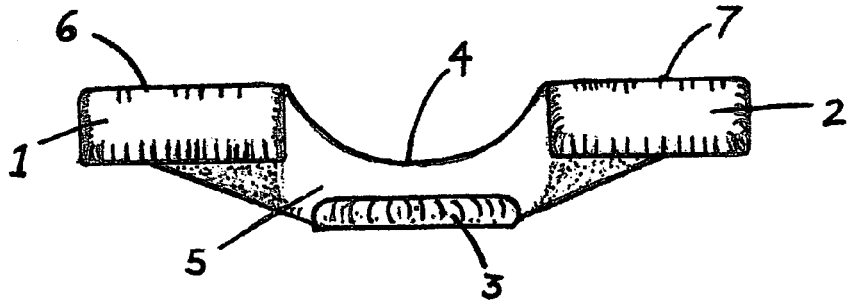
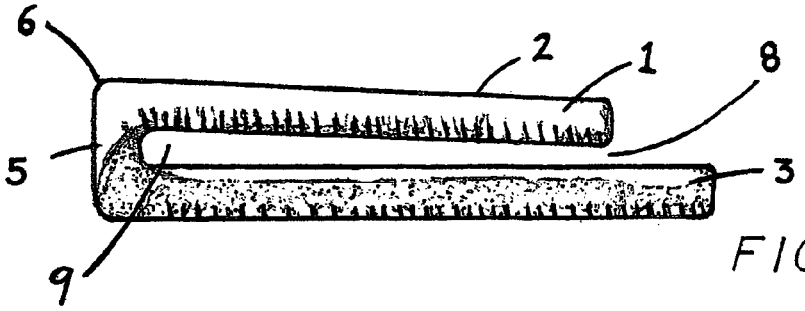
FIG. 2C
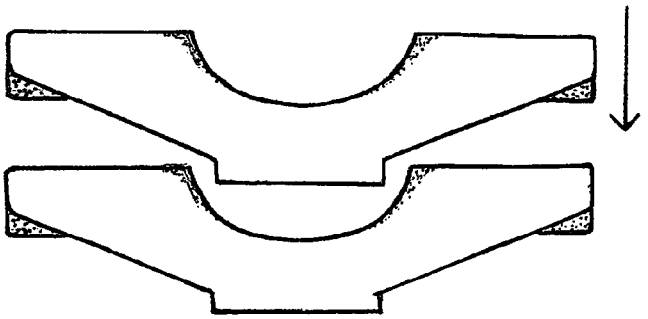
FIG. 2D

FIG. 3A
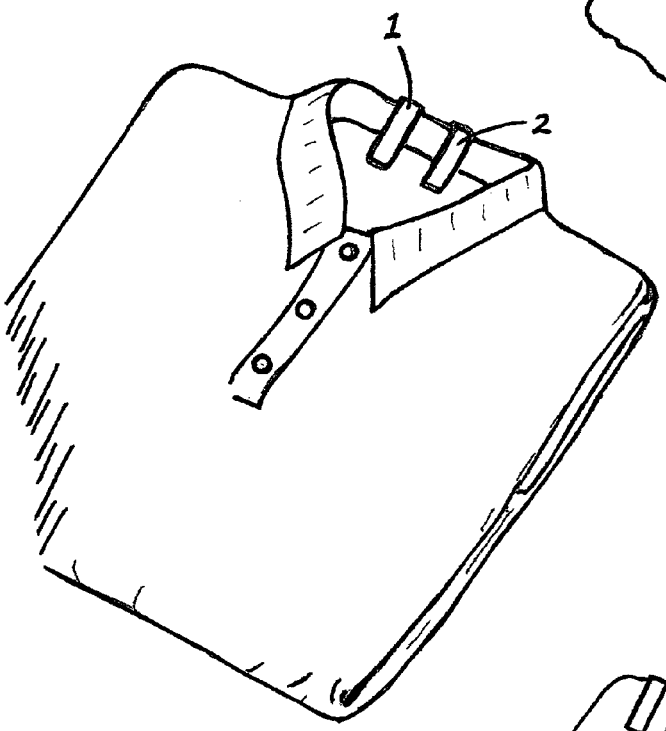
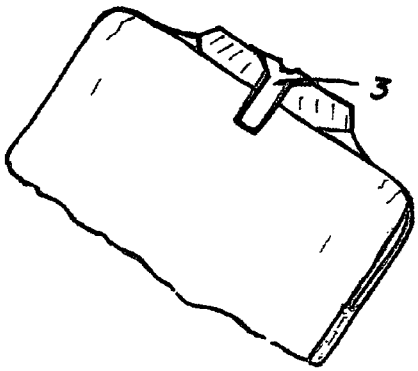
FIG. 3B
FIG. 4A
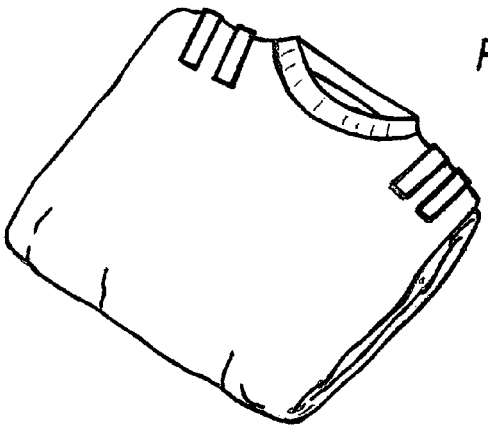
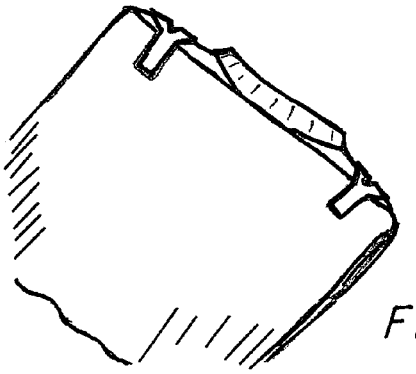
FIG. 4B

FOLDED CLOTHING CLIP HOLDER

The present invention is a folded clothing clip holder, referred later as clip holder or holder, designed to maintain the folded status of fabric, underwear, socks or shirts. The clip holder, which is composed of a flexible material such as polyurethane, plastic, nylon, or metal, is applied to a folded shirt at the collar and the center of the fold or evenly at the shoulders using two holders to maintain the folded status of the cloth, underwear or garment. This clip holder has two horizontal parallel posts on one side that descend or curve down and then converge after the curve forming a single post which again curves horizontally in the same direction as the to posts above it, running almost parallel with the two posts. The narrower single post is also visibly centered between the two posts and is slightly longer as well. From the side view, the top posts and bottom post converge slightly to create a smaller spacing at the opening compared to the interior of the clip holder. The narrow spacing helps to secure the placement of the holder while maintaining the garment's folded state making the garment more neatly stackable and also maintaining the folded status if the stacked clothing or other items are knocked over or dropped.

BACKGROUND OF INVENTION

In today's society when the production and acquisition of many goods and services occurs at very affordable rates, people often buy things for the variety or just because they are on sale. Even for those with exquisite tastes, who only buy high-end clothing, they almost all need help organizing or helping to maintain an organized appearance of the garments that they acquire. Whether it is a lot or a small amount, the clothing, particularly the folded garments, eventually reach a state of disarray for the normal common individual. The reach this state because people don't take the next garment or shirt on the top of the folded stack. Even if they attempted to do so, that shirt would not always coordinate with what the person is preparing to wear. Therefore they must move the garments around to get the one they want. In doing so, the stacked garments eventually become unfolded and inevitably unorganized.

This is the concept of the present invention. It is designed to help maintain the folded status of the fabric, garment or underwear on which it is applied. When applied to the folded garment, it lessens the likelihood of total disarray of the stack of folded garments by maintaining the folded state of each item. Even if the stack falls or is knocked over, the applied present invention maintains the folded state of the garment and allows it to be easily restacked without needing to be refolded. The present invention also makes the organization of the folded garments easier because of a feature that makes the garment more evenly stackable when it is applied in the same location on each folded garment.

U.S. Pat. App. Pub to Blitstein et al. U.S. 2005/0125960 A1 is a baby blanket clip designed to keep the blanket attached to the carriage. However, although the components of the design were only slightly similar this invention was designed to hold fabric in place on an apparatus and not a stand-alone application. There were no other designs to do what the present invention is designed to do.

SUMMARY OF INVENTION

The present invention is a clip holder that can be applied to fabric or clothing, specifically shirts or underwear, designed to aid in maintaining the folded status of the garment. The holder has two horizontal, parallel posts with space between them on one side, which descend or curve down on the same end and then converge to form a single post in the center, which then turns horizontally in the same direction as the two posts above and is almost parallel to the two posts. From a side view, the shape of the holder appears as a "U" shape, which narrows at the opening compared to the interior of the holder. It is this narrowing that enhances the gripping ability of the holder on the folded garment. The narrower single post also fits between the top posts when two folded garments with the present invention applied are stacked one on top of the other.

BRIEF DESCRIPTION OF THE DRAWINGS

The present invention and complete understanding thereof will become more apparent as the description is given of the drawings.

FIG. 2A is the back view.

FIG. 2B is a view from the front of the holder opposite of FIG. 2A.

FIG. 2C is a side view of the holder.

FIG. 2D is a view of two stacked holders.

FIG. 3A is a perspective and topside view of the holder attached to a sample garment in folded state in the center of the collar.

FIG. 3B is the opposite side view of the FIG. 3A.

FIG. 4A is a topside or perspective view of the holder attached to a sample folded garment at two points (the shoulder) of the garment.

FIG. 4B is an opposite view of FIG. 4B.

DETAILED DESCRIPTION OF THE INVENTION

Figure 1A:
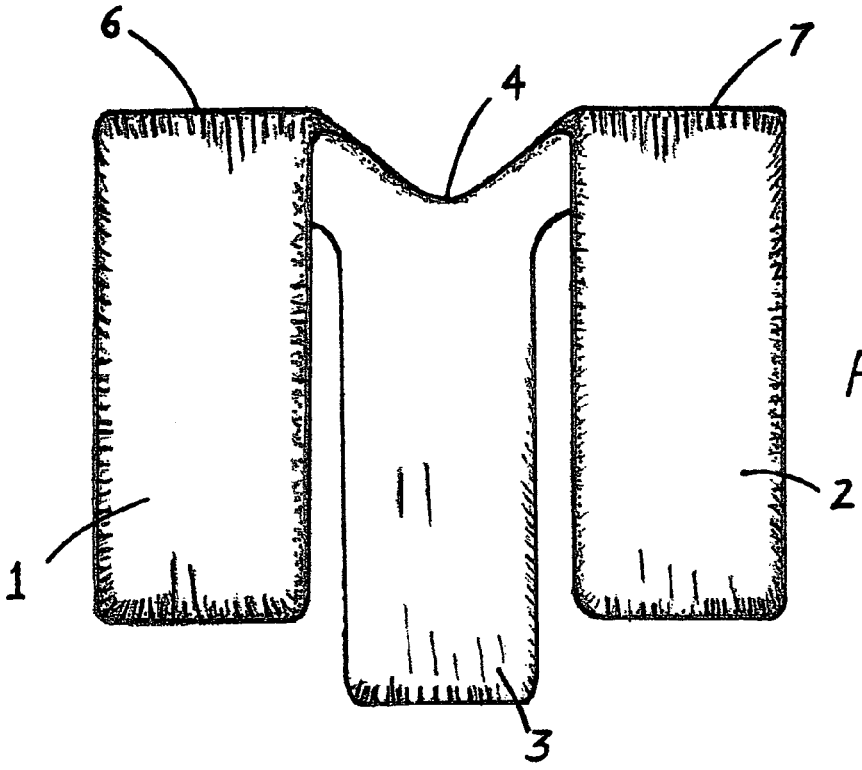
FIG. 1A is a top view of the holder.

FIG. 1A shows a top view of the clip holder. This view shows the features designated as 1, 2, 3, 4, 6 and 7. Features 1, 2, and 3 show the posts of the holder. The top posts, 1 and 2, are the same width, length, are parallel and are oriented in the same direction. 3 is smaller in width but longer than 1 and 2 and centered between 1 and 2 according to the perspective of FIG. 1A. 1 and 2 descend at points 6 and 7 and converge to form a concave spacing indicated as feature 4.

Figure 1B:
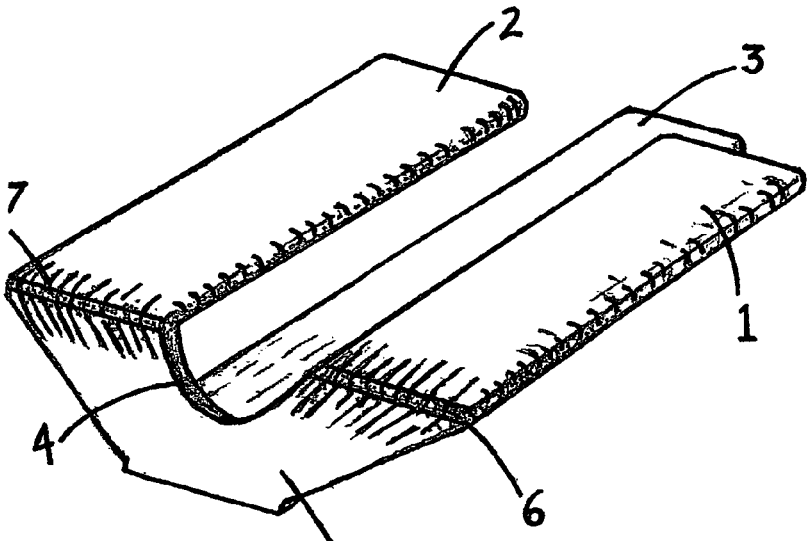
FIG. 1B is a perspective view of the holder.

FIG. 1B is the perspective view that shows feature 5 formed as 1 and 2 descend at points 6 and 7 to create 5 and form feature 4. Also indicated by this view is the more elongated post, which is feature 3.

FIG. 2A is the back view of the holder. The properties and components of this view are the same as FIG. 1A and FIG. 1B. Feature 3 is indicated to show the area where 3 is located in this view.

FIG. 2B is the opposite view of FIG. 2A. It also indicates the components of the holder described in FIG. 1B and FIG. 2A. In the view, 3 is positioned and centered between 1 and 2.

FIG. 2C is a side view of the holder. From this perspective, the top post(s) indicated as feature 1 (and 2) is shown to not be parallel to the bottom post indicated as feature 3. Shown is the narrowing of the holder at the opening indicated as feature 8. It narrows compared to the interior space of the holder indicated as component 9. Also indicated by this perspective of FIG. 2C is the consistent thickness of the clip holder at most points. This narrowing of the spacing from the interior, 9, to the opening, feature 8, of the holder is to more securely grip the fabric or garment on which it is applied.

FIG. 2D is a back view of the holder such as FIG. 2B. This view is of two holders as they would appear if they were applied to garments and stacked in a folded state with the arrow indicating the direction for stacking.

FIG. 3A is a view of the invention being applied to a folded garment, for example a folded shirt, in the center. Visible are the two top posts, features 1 and 2, of the holder over the collar of the folded garment.

FIG. 3B is the opposite view of FIG. 3A. It shows the holder applied to the folded garment with feature 3, the bottom post, on the underside of the shirt being visible.

FIG. 4A is the perspective view of another folded garment with two holders, described in FIG. 1A attached at two positions (the shoulders) near the neck of the folded garment.

FIG. 4B is the opposite view of FIG. 4A. It shows feature 3, the single post, of the two holders attached to the underside of the folded garment. It shows the folded garment being held in place at the shoulders of the shirt. The above-described present invention may be formed from metal, plastic, polyurethane, or nylon to aid in the flexibility of the invention for its most effective application.

This present invention is an improvement over any existing ideas of organization of garments to help maintain the folded status of fabric, garments, or underwear. There are modifications that may be made thereunto the present invention without departing from the spirit and scope of the invention.

What is claimed is:

1. A clip holder for maintaining a folded status of a fabric or garment comprising:

spaced, horizontal and parallel first and second posts;

a curved or flat back section that descends at an angle from the first and second top posts and converges to a third post;

the third post almost parallel to the first and second posts and positioned between the first and second posts, defining an interior space with an opening for receiving the folded fabric or garment that is narrower at the opening than at the back section; and wherein the spacing between the first and second posts and the third post is sufficiently narrow or close as to create or cause friction against the fabric or garment to maintain placement of the holder on the fabric or garment.

2. The holder of claim 1 wherein first, second and third posts are comprised of a flexible material selected from the group consisting of plastic, polyurethane, nylon, metal, or combinations thereof.

3. The holder of claim 1, wherein the portions of the first, second, and third posts defining the interior space have textured surfaces to frictionally grip the fabric or garment.

4. The holder of claim 1 having affixed to it or engraved in it a logo or trademark.

5. The holder of claim 1, wherein the spacing of the first, second, and third posts enables the holder to be stackable with like holders.

6. The holder of claim 1 sized to receive the fabric or garment to maintain the folded status of said fabric or garment.

7. The holder of claim 6 that facilitates stacking of said folded fabrics or garments and maintains the folded status of each said fabric or garment within the stack when such stack is disturbed.

* * * * *